US008456461B2

(12) United States Patent
Stephens

(10) Patent No.: US 8,456,461 B2
(45) Date of Patent: Jun. 4, 2013

(54) APPARATUS AND METHOD FOR AMBIENT LIGHT DETECTION AND POWER CONTROL VIA PHOTOVOLTAICS

(75) Inventor: Michael John Stephens, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 694 days.

(21) Appl. No.: 12/771,526

(22) Filed: Apr. 30, 2010

(65) Prior Publication Data

US 2011/0267324 A1 Nov. 3, 2011

(51) Int. Cl.
*G09G 5/00* (2006.01)

(52) U.S. Cl.
USPC ..... 345/207; 345/95; 345/212

(58) Field of Classification Search
USPC ..... 345/87–100, 204–215
See application file for complete search history.

(56) References Cited

U.S. PATENT DOCUMENTS

2012/0087115 A1* 4/2012 Maxik ..... 362/231
2012/0306382 A1* 12/2012 Maxik et al. ..... 315/152

* cited by examiner

*Primary Examiner* — Vijay Shankar

(57) ABSTRACT

A method and apparatus for ambient light detection and power control using photovoltaics is disclosed. In an embodiment, a device includes a display and a photovoltaic cell. The photovoltaic cell acts as both an ambient light sensor and a power source. Based on the detected ambient light level, the brightness of the display is increased or decreased to save power, and energy captured by the photovoltaic cell is converted into a useable power signal which is stored or used by device components.

20 Claims, 3 Drawing Sheets

APPARATUS AND METHOD FOR AMBIENT LIGHT DETECTION AND POWER CONTROL VIA PHOTOVOLTAICS

TECHNICAL FIELD

The present disclosure relates in general to using photovoltaics, and, in particular, to methods and apparatus for ambient light detection and power control using photovoltaics.

BACKGROUND

A wide range of devices use displays to convey information to a user. Displays are becoming increasingly common on various devices, including both mobile devices and stationary devices. For example, various electronic devices, such as mobile phones, personal digital assistants ("PDAs"), smartphones, laptops, netbooks, tablet computers, desktop computers, and various other handheld devices use displays to convey information and/or provide entertainment to a user. Devices such as automated teller machines, vending machines, and parking meters, are frequently using displays to convey information to a user. Additionally, vehicles such as cars, trucks, busses, trains, airplanes, and boats frequently have displays for providing information to passengers. Essentially, displays are becoming an increasingly common component of devices in all facets of life.

For example, the trend of using displays is particularly prominent with portable electronic devices such as cellular phones. There is somewhat of a trend towards using touch screen displays in many portable electronic devices, and generally, there is a trend to make displays larger. However, the trend to increase display size is typically at odds with a trend to decrease the size of portable electronic devices. A common theme with portable electronic devices is that users typically prefer devices that are compact and have a long battery life, which promotes simplified transporting of the device and ease of use in remote locations without requiring any connection to a power grid.

While users often prefer smaller devices with relatively large display screens, there are some drawbacks to electronic devices of the prior art. The trend to make electronic devices with larger display screens and/or touch screens has caused the display in many devices to consume a relatively large amount of power. Accordingly, devices have included light sensors to determine whether the ambient light level requires the display to operate at a maximum brightness level. For example, a display may operate at a maximum brightness level if the device is located outside in the sunlight, so that the user of the device can adequately see the image displayed. However, the display may operate a limited brightness level if the device is located in darkness, because the image does not need to be displayed with the maximum brightness for the user to see the image. By altering the brightness level of the display, the device can conserve power when the ambient light level of the device low, while still providing an image the user can see when the ambient light level is high.

The prior art methods of dealing with setting the display brightness includes using ambient light sensors. Light sensors are often difficult to implement in an optimal position on a device because of device design limitations. For example, on a mobile phone, light sensors may be located in the corner of a device, which can decrease the effectiveness in detecting the ambient light if that corner is covered by a user's hand or otherwise obstructing the actual ambient light level from being sensed. For example, if a mobile phone included ambient light sensors prominently located in various positions of the phone to ensure proper ambient light detection, the device may be unappealing to users because of the non-discreet location of the light sensors. Accordingly, there is a trend in minimizing the noticeability of the ambient light sensors on mobile devices by placing the light sensors in a discreet location and making the light sensors small in size. By putting the light sensor in a more discreet location, a device may be seen as having an improved look, however, the actual effectiveness of the light sensor may be decreased based on its position. If ambient light is not properly detected, the device may use more power than necessary to adequately display an image. Accordingly, failing to optimally control the brightness of an image and the power to display the image lowers efficiency and can decrease battery life. Further, an ambient light sensor may use power from a device battery or other power source, which decreases the battery life and/or makes the device less efficient. Typically, users prefer long battery life and/or high efficiency products, so decreasing power consumption is generally desirable to users.

Accordingly, manufacturers and users of devices face challenges detecting ambient light, controlling power used by a display based on the ambient light, and in prolonging battery life and/or increasing device efficiency. The prior art fails to provide a sufficient solution for the above described challenges.

SUMMARY

The present disclosure provides a new and innovative method and apparatus for ambient light detection and power control using photovoltaics. In an embodiment, a device includes a display and a photovoltaic cell. The photovoltaic cell acts as both an ambient light sensor and a power source. Based on the detected ambient light level, the brightness of the display is increased or decreased to save power, and energy captured by the photovoltaic cell is converted into a useable power signal which is stored or used by device components.

Additional features and advantages of the disclosed method and apparatus are described in, and will be apparent from, the following Detailed Description and the Figures.

DETAILED DESCRIPTION

Figure 1:
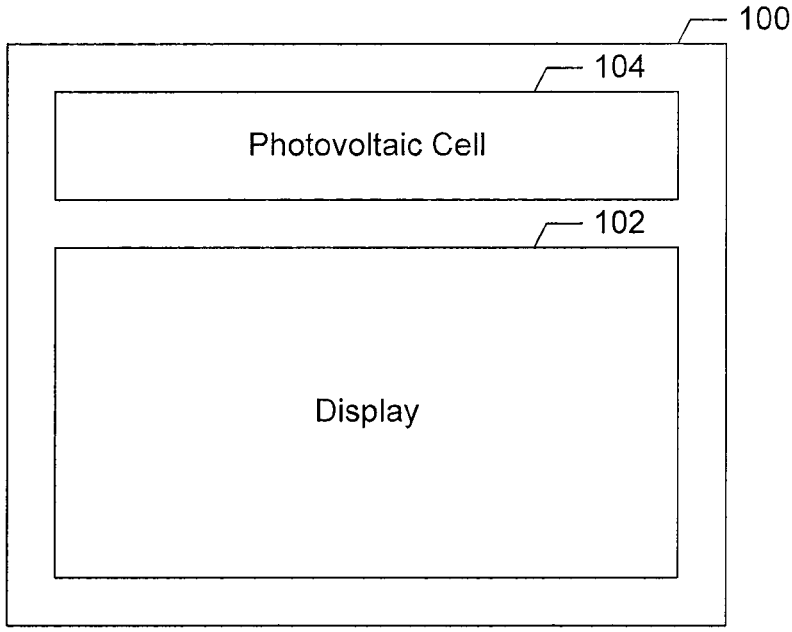
FIG. 1 is an illustration of an example embodiment of a device for ambient light detection and power control using photovoltaics.

An illustration of an example embodiment of a device 100 for ambient light detection and power control using photovoltaics is shown in FIG. 1. In an example embodiment, the device 100 may be a mobile telephone that includes a display 102. The display 102 may be, for example, a liquid crystal display ("LCD screen"). It should be appreciated that the display 102 may in various embodiments be selected from a wide variety of display types including an LCD screen, a plasma display panel ("PDP screen"), a cathode ray tube display ("CRT screen"), a digital light processing display ("DLP screen"), a field emission display ("FED screen"), a surface-conduction electron-emitter display ("SED screen"), a liquid crystal on silicon display ("LCOS screen"), an interferometric modulator display ("IMOD screen"), a time multiplexed optical shutter display ("TMOS screen"), a light emitting diode display ("LED screen"), an organic light emitting diode display ("OLED screen"), a vacuum fluorescent display ("VFD screen"), a seven segment display ("7SD screen"), flat panel display ("FPD screen"), and/or a touch screen display ("touch screen").

The device 100 includes one or more photovoltaic cell 104. For example, the photovoltaic cell 104 may be part of a group of photovoltaic cells, a photovoltaic cell array, and/or a photovoltaic cell module. It may be preferable to locate the photovoltaic cell 104 prominently on the device 100 rather than discreetly. As shown in the example embodiment illustrated in FIG. 1, the photovoltaic cell 104 is located above the display 102 and constitutes a relatively large portion of the device 100, and is nearly as large as the display 102. Such a configuration may be preferable for various reasons from an efficiency standpoint, a marketing standpoint, and/or a manufacturing standpoint. It should be appreciated that the photovoltaic cell 104 generates electrical energy in the form of an electric current when the photovoltaic cell 104 is exposed to electromagnetic waves such as visible light. As described in greater detail below, the device 100 may use the energy received from the electromagnetic waves for ambient light detection and power control.

Figure 2:
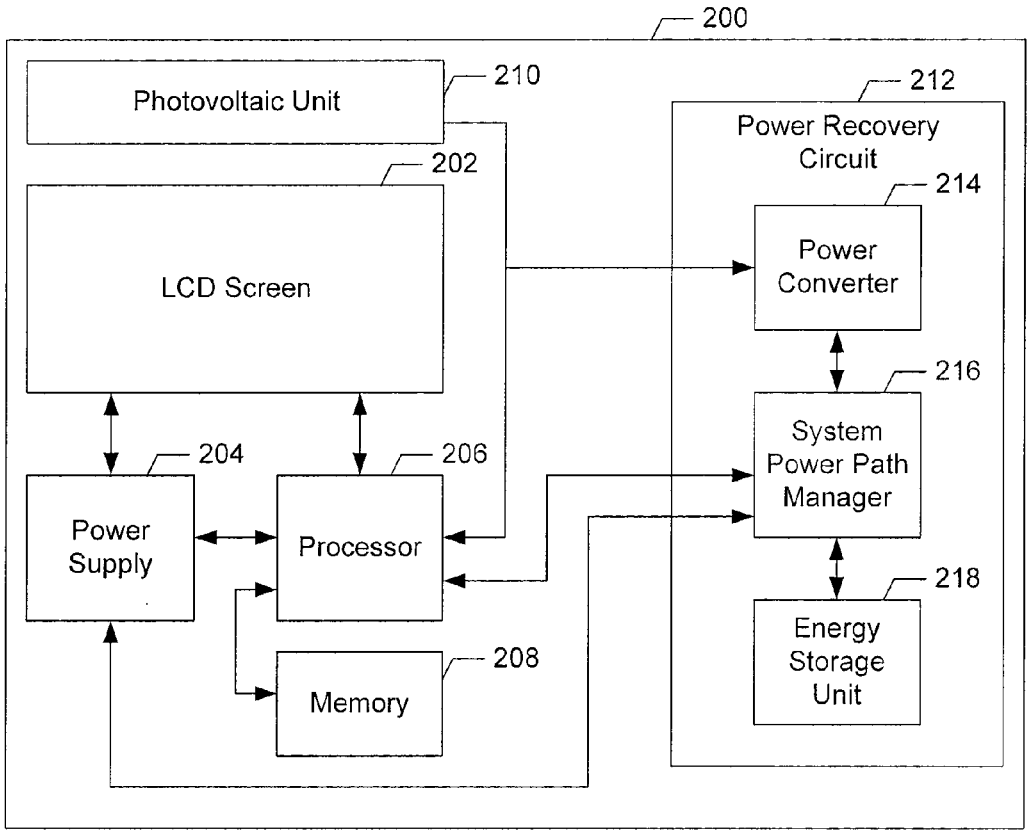
FIG. 2 is a high level block diagram of an example embodiment of a device for ambient light detection and power control using photovoltaics.

A high level block diagram of an example embodiment of a device 200 for ambient light detection and power control using photovoltaics is shown in FIG. 2. In an example embodiment, the device 200 includes an LCD screen 202 powered by a power supply 204. The power supply 204 may provide a specified operating voltage to the LCD screen 202 and may provide a specified operating voltage to the processor 206. The processor provides a display signal that includes data indicative of the brightness level of the LCD screen 202. The display signal may be sent to the LCD screen 202 and/or the power supply 204. In an example, embodiment, the display signal is broken down into a signal specifying the image to display and a signal specifying brightness of the image to display. A memory device 208 is operatively coupled to the processor 206, and may provide the processor with image and brightness data. In an example embodiment, a memory device 208 may be a random access memory, electronic programmable read only memory, or any other computer readable memory device, and may store software instructions to cause a computing device or a processor 206 to carry out the stored software instructions.

In the example embodiment illustrated in FIG. 2, a photovoltaic unit 210 converts the ambient light energy at the device 200 into an electric current. The photovoltaic unit 210 may output a relatively high current at a relatively low voltage, however, a plurality of photovoltaic units 210 may produce a relatively high voltage. In the example embodiment illustrated in FIG. 2, the output current from the photovoltaic unit 210 is provided to a power recovery circuit 212 to condition the electric current, which allows the ambient light energy to be conditioned into a useable power signal by the device 200. The example power recovery circuit 212 includes a power converter 214 that takes in the electric current from the photovoltaic unit 210 and conditions it into a conditioned power signal. In an example embodiment, the power converter 214 may be a boost converter that steps up the voltage while stepping down the current to create a conditioned power signal. The example boost converter may be a high efficiency boost converter, which can increase efficiency of the power recovery circuit 212. The power recovery circuit 212 uses the power converter 214 to condition the output signal of the photovoltaic unit 210 into a power signal suited for use by the system power path manager 216. The system power path manager 216 determines how to use the conditioned power signal. The system power path manager 216 can provide the conditioned power signal to an energy storage unit 218, for example, a rechargeable battery. Also, the system power path manager 216 can provide the conditioned power signal to the power supply 204, thus, directly using the energy captured by the power recovery circuit 212.

In an example embodiment, the system power path manager 216 may provide the conditioned power signal to the power supply 204 when the LCD screen 202 is drawing a high level of power, and provide the conditioned power signal to the energy storage unit 218 when the LCD screen 202 is drawing a low level of power. In an example embodiment, the system power path manager 216 communicates with the processor 206 to determine how the energy captured by the photovoltaic unit 210 should be used. It should be appreciated that various configurations may be used to maximize energy capture efficiency, based on the particular components used in the device 200, the energy storage unit 218 recharge characteristics, LCD screen 202 power requirements, etc. Accordingly, a conditioned power signal may be used to recharge the energy storage device 218 for a period of time, then later in different ambient light conditions, may be used to provide power to a component such as the power supply 204, the LCD screen 202, and/or the processor 206. Accordingly, the example device 200 may simultaneously recover power used in the ambient light detection and reduce power consumption by reducing the power needed by the LCD screen 202.

In a typical scenario, when the LCD screen 202 is operating at maximum brightness, and the device 200 is using the maximum amount of power on the LCD screen 202, the photovoltaic unit 210 and power recovery circuit 212 are beneficially providing maximum power recovery. On the other hand, when the photovoltaic unit 210 and power recovery circuit 212 are producing minimal power recovery, the LCD screen 202 will be operating a minimal brightness level, thus using a minimal amount of power. Accordingly, the efficiency and/or battery life of the device 200 can be increased regardless of the ambient light conditions the device 200 is operating in.

It should be appreciated that various analog and/or digital processing circuitry may be used for processing the electric current produced by the photovoltaic unit 210 to determine the ambient light level. It should further be appreciated that the device 200 may be configured to alter or omit certain aspects shown in FIG. 2, for example, the LCD screen 202 may be powered directly by the processor 206, the power converter 214 may receive the electric current produced by the photovoltaic unit 210 from the processor 206, the power supply 204 and the processor 206 may be a single integrated unit, the device 200 may include a plurality of displays 202 and/or photovoltaic units 210, etc.

The challenges of prolonging battery life and increasing device efficiency are applicable to many different types of devices, including portable devices and non-portable devices, devices which operate on rechargeable batteries and non-rechargeable batteries, devices which do not use batteries and only use power from a power grid, and devices which use batteries as well as power from a power grid. Photovoltaic cells may be used to save power in various kinds of portable devices, for example, a personal digital assistant or PDA, a smartphone, a laptop, a netbook, a tablet computer, a desktop computer, a portable media player, a GPS navigation device, a rangefinder, a barcode scanner, an RFID reader, a digital camera, a handheld video game console, a calculator, and any other handheld electronic device or portable electronic device. Also, photovoltaic cells may be used to save power in various kinds of stationary devices such as automated teller machines, vending machines, parking meters, and various other outdoor and indoor displays, monitors, and screens. Further, photovoltaic cells may be used to save power in vehicles such as cars, trucks, busses, trains, airplanes, and boats. Moreover, photovoltaic cells, or photovoltaics, may be used to capture energy for the virtually any device that uses an electronic display, and effectively, save power for the device.

Generally, energy capture or power recovery and/or reduced power consumption may be generally referred to as saving power. For example, if a battery life is extended by reducing the brightness level of a display, thereby reducing the amount of power used by the display, then the device saves power. Similarly, if a device uses less power from a power grid by reducing the brightness level of a display, then the device is operating more efficiently and saves power. For example, if a battery life is extended by recharging the battery with the energy captured by the photovoltaic cell, the device saves battery power which would have been expended had the photovoltaic cell not recharged the battery. Similarly, if a device uses less power from a power grid by recharging the battery with the energy captured by the photovoltaic cell, the device is operating more efficiently overall, thus saving power used from the power grid.

Further, it should be appreciated that using photovoltaic cells to capture energy from ambient light may be most efficient and effective when the photovoltaic cells are prominently located on the device. When the photovoltaic cells are not prominently located on a device, the photovoltaic cells may still prolong the battery life and/or increase device efficiency. Also, prominently located photovoltaic cells may make a device more marketable to consumers that seek environmentally friendly and cost effective products. Further, it should be appreciated that different photovoltaic cells may be optimized to absorb different frequency ranges of energy. For example, a first photovoltaic cell may be optimized to absorb energy from sunlight, while a second photovoltaic cell energy may be optimized to absorb energy from a different light source, such as fluorescent lights. Accordingly, the actual amount of energy which is absorbed by the photovoltaic cells, and the resulting amount of power recovered, depends on various factors including the efficiency of the photovoltaic cells, the placement of the photovoltaic cells, and the ambient light conditions for a user's use of the device.

Figure 3:
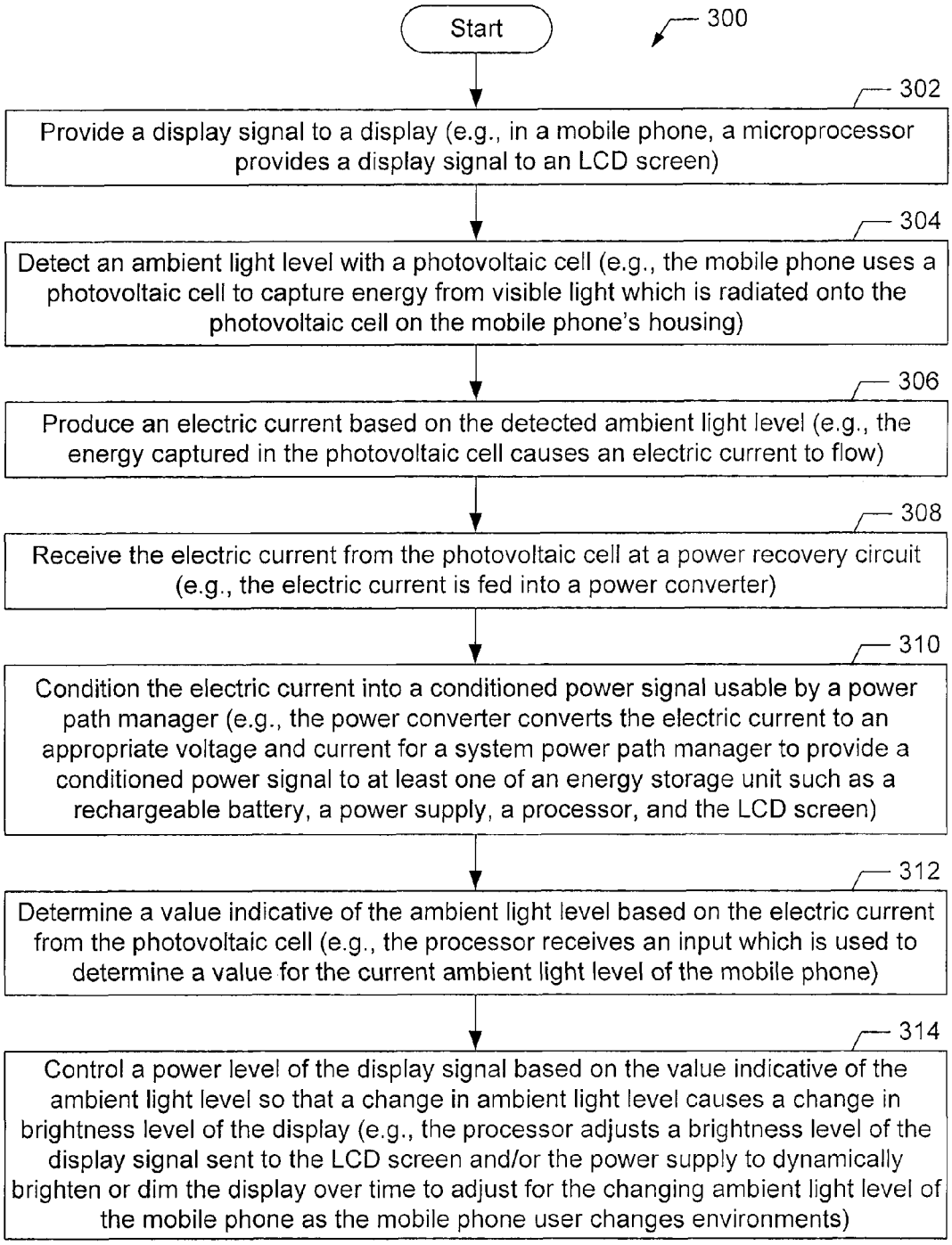
FIG. 3 is a flowchart of an example embodiment of an ambient light detection and power control process.

FIG. 3 is a flowchart of an example embodiment of an ambient light detection and power control process 300. Although the ambient light detection and power control process 300 is described with reference to the flowchart illustrated in FIG. 3, it will be appreciated that many other methods of performing the acts associated with the example ambient light detection and power control process 300 may be used. For example, the order of some of the blocks may be changed, and some of the blocks described are optional.

The example ambient light detection and power control process 300 begins with providing a display signal to a display (block 302). For example, in a mobile phone, a microprocessor provides a display signal to an LCD screen. The display signal may be provided via a wide variety of interfaces or ports (e.g., serial, parallel, digital, analog), and may include image data and brightness data either in an integrated fashion or as separate and distinct data. Also, the process 33 requires detecting an ambient light level with a photovoltaic cell (block 304). For example, the mobile phone uses a photovoltaic cell to capture energy from visible light which is radiated onto the photovoltaic cell on the mobile phone's housing. As discussed above, the size, location, type, and number of photovoltaic cells can be optimized to each device based on its intended use, how the user interacts with a device, and various other factors.

When the photovoltaic cell captures energy from the ambient light level, the photovoltaic cell produces an electric current based on the detected ambient light level (block 306). For example, the energy captured in the photovoltaic cell causes an electric current to flow. The electric current from the photovoltaic cell is received at a power recovery circuit (block 308). For example, the electric current is fed into a power converter. When the power converter receives the electric current, the electric current is processed into a conditioned power signal usable by a power path manager (block 310). For example, the power converter converts the electric current to an appropriate voltage and current for a system power path manager to provide a conditioned power signal to at least one of an energy storage unit such as a rechargeable battery, a power supply, a processor, and the LCD screen. In an example embodiment, the power convert is a high efficiency boost converter, which steps up the voltage to a desired voltage for use by the system power path manager.

A value indicative of the ambient light level is determined based on the electric current from the photovoltaic cell (block 312). For example, the processor receives an input which is used to determine a value for the current ambient light level of the mobile phone. It should be appreciated that various methods may be employed to manipulate the electric current and/or voltage outputted by the photovoltaic cell to create a useable signal to determine the ambient light level. Once the value indicative of the ambient light level is determined, a power level of the display signal is controlled based on the value indicative of the ambient light level so that a change in ambient light level causes a change in brightness level of the display (block 314). For example, the processor adjusts a brightness level of the display signal sent to the LCD screen and/or the power supply to dynamically brighten or dim the display over time to adjust for the changing ambient light level of the mobile phone as the mobile phone user changes environments.

Accordingly, using the example ambient light detection and power control process 300 allows a device to save power by using less power from an energy source such as a battery and/or a power grid and by using less power to display images based on the ambient light level. Using the example ambient light detection and power control process 300 may improve various aspects of a device, which may make the device less costly, more marketable and/or popular, and ultimately provide a better user experience. For example, the ambient light detection and power control process 300 may allow for increased battery life; a smaller, more lightweight, and/or more cost effective battery; a more compact and user friendly design; increased operating speed and less throttle down requirements; a highly marketable design; increased overall energy efficiency; lower power consumption and/or recharging costs from a power grid; and/or increased overall device performance.

It should be understood that various changes and modifications to the example embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An apparatus for ambient light detection and power control using photovoltaics, comprising:

a processor;

a display operatively coupled to the processor;

a power supply powering at least one of the processor and the display;

a photovoltaic cell detecting an ambient light level and producing an electric current based on the ambient light level;

a power recovery circuit receiving the electric current from the photovoltaic cell and conditioning the electric current to provide a conditioned power signal to at least one of an energy storage unit, the power supply, the processor, and the display, the conditioned power signal being useable by the at least one of the energy storage unit, the power supply, the processor, and the display; and a memory device operatively coupled to the processor, the memory device storing instructions to cause the processor to:

provide a display signal to the display;

determine a value indicative of the ambient light level based on the electric current; and control a power level of the display signal based on the value indicative of the ambient light level such that a change in the ambient light level causes a change in a brightness level of the display to reduce power consumption.

2. The apparatus of claim 1, wherein the apparatus is a portable electronic device.

3. The apparatus of claim 1, wherein the energy storage unit is a rechargeable battery.

4. The apparatus of claim 1, wherein the photovoltaic cell is part of a at least one of a photovoltaic cell module, a photovoltaic cell array, and a plurality of photovoltaic cells.

5. The apparatus of claim 1, wherein the photovoltaic cell is optimized to absorb energy in the visible light frequency range.

6. The apparatus of claim 1, wherein the photovoltaic cell is prominently located on the apparatus.

7. The apparatus of claim 1, wherein the power recovery circuit includes a high efficiency boost converter to condition the energy received from the photovoltaic cell into the conditioned power signal in a specified current range and in a specified voltage range.

8. The apparatus of claim 1, wherein the display is at least one of a liquid crystal display, a plasma display panel, a cathode ray tube display, a digital light processing display, a field emission display, a surface-conduction electron-emitter display, a liquid crystal on silicon display, an interferometric modulator display, a time multiplexed optical shutter display, a light emitting diode display, an organic light emitting diode display, a vacuum fluorescent display, a seven segment display, flat panel display, and a touch screen display.

9. The apparatus of claim 1, wherein the power level of the display signal is at a first power level when the ambient light level is high and the power level of the display signal is at a second power level when the ambient light level is low, the first power level being greater than the second power level.

10. The apparatus of claim 1, wherein the apparatus saves power by simultaneously control a power level of the display signal to reduce power consumption and at least one of the energy storage unit, the power supply, the processor, and the display using the conditioned power signal as a power source.

11. A method for ambient light detection and power control using photovoltaics, comprising:

detecting an ambient light level with a photovoltaic cell;

producing an electric current based on the detected ambient light level;

receiving the electric current from the photovoltaic cell at a power recovery circuit;

conditioning the electric current with the power recovery circuit to provide a conditioned power signal to at least one of an energy storage unit, a power supply, a processor, and a display, the conditioned power signal being useable by the at least one of the energy storage unit, the power supply, the processor, and the display;

providing a display signal to the display;

determining a value indicative of the ambient light level based on the electric current; and controlling a power level of the display signal based on the value indicative of the ambient light level such that a change in the ambient light level causes a change in a brightness level of the display to reduce power consumption.

12. The method of claim 11, wherein the photovoltaic cell is part of a at least one of a photovoltaic cell module, a photovoltaic cell array, and a plurality of photovoltaic cells.

13. The method of claim 11, wherein the power recovery circuit includes a high efficiency boost converter to condition the energy received from the photovoltaic cell into the conditioned power signal in a specified current range and in a specified voltage range.

14. The method of claim 11, wherein the display is at least one of a liquid crystal display, a plasma display panel, a cathode ray tube display, a digital light processing display, a field emission display, a surface-conduction electron-emitter display, a liquid crystal on silicon display, an interferometric modulator display, a time multiplexed optical shutter display, a light emitting diode display, an organic light emitting diode display, a vacuum fluorescent display, a seven segment display, flat panel display, and a touch screen display.

15. The method of claim 11, wherein the power level of the display signal is at a first power level when the ambient light level is high and the power level of the display signal is at a second power level when the ambient light level is low, the first power level being greater than the second power level.

16. The method of claim 11, wherein the power level of the display signal is reduced when the ambient light level is low to save power.

17. The method of claim 11, wherein the conditioned power signal recharges a rechargeable battery in the energy storage unit to save power.

18. The method of claim 17, wherein the power level of the display signal is reduced when the ambient light level is low simultaneously with the conditioned power signal recharging the rechargeable battery to save power.

19. A computer readable device storing software instructions to cause an apparatus for ambient light detection and power control using photovoltaics to:

provide a display signal to a display;

receive a signal indicative of an ambient light level from a photovoltaic cell;

determine a value indicative of the ambient light level based on the signal;

control the use of a conditioned power signal generated from the photovoltaic cell such that the conditioned power signal is at least one of stored in an energy storage unit, used by a power supply, used by a processor, and used by a display; and control a power level of the display signal based on the value indicative of the ambient light level such that a change in the ambient light level causes a change in a brightness level of the display to reduce power consumption.

20. The computer readable device of claim 19, wherein the apparatus saves power by simultaneously controlling a power level of the display signal to reduce power consumption and at least one of the energy storage unit, the power supply, the processor, and the display using the conditioned power signal as a power source.

* * * * *

UNITED STATES PATENT AND TRADEMARK OFFICE

CERTIFICATE OF CORRECTION

PATENT NO. : 8,456,461 B2
APPLICATION NO. : 12/771526
DATED : June 4, 2013
INVENTOR(S) : Michael John Stephens It is certified that error appears in the above-identified patent and that said Letters Patent is hereby corrected as shown below:

In the Claims

In column 7, line 34, in Claim 4, delete "of a at" and insert -- of at --, therefor.

In column 8, line 21, in Claim 12, delete "of a at" and insert -- of at --, therefor.

Signed and Sealed this
Twentieth Day of August, 2013

Teresa Stanek Rea
*Acting Director of the United States Patent and Trademark Office*